US009394581B2

(12) United States Patent
Han et al.

(10) Patent No.: US 9,394,581 B2
(45) Date of Patent: Jul. 19, 2016

(54) HEAT TREATMENT METHOD FOR BAINITIC TURNOUT RAIL

(71) Applicant: PANGANG GROUP PANZHIHUA IRON & STEEL RESEARCH INSTITUTE CO., LTD., Panzhihua, Sichuan Province (CN)

(72) Inventors: Zhenyu Han, Panzhihua (CN); Ming Zou, Panzhihua (CN); Jihai Jia, Panzhihua (CN); Hua Guo, Panzhihua (CN); Yanzhong Wang, Panzhihua (CN); Jianhua Liu, Panzhihua (CN); Yong Deng, Panzhihua (CN); Chunjian Wang, Panzhihua (CN)

(73) Assignee: PANGANG GROUP PANZHIHUA IRON & STEEL RESEARCH INSTITUTE CO., LTD., Panzhihua, Sichuan Province (CN)

( * ) Notice: Subject to any disclaimer, the term of this patent is extended or adjusted under 35 U.S.C. 154(b) by 593 days.

(21) Appl. No.: 13/974,744

(22) Filed: Aug. 23, 2013

(65) Prior Publication Data

US 2014/0060710 A1 Mar. 6, 2014

(30) Foreign Application Priority Data

Aug. 28, 2012 (CN) ..... 2012 1 0309012

(51) Int. Cl.
*C21D 9/04* (2006.01)

(52) U.S. Cl.
CPC ..... *C21D 9/04* (2013.01); *C21D 2211/002* (2013.01)

(58) Field of Classification Search
CPC ..... C21D 9/04; C21D 2211/002
See application file for complete search history.

(56) References Cited

U.S. PATENT DOCUMENTS 5,382,307 A * 1/1995 Kageyama ..... C21D 1/20 148/320
7,854,883 B2 12/2010 Kueppers et al.

FOREIGN PATENT DOCUMENTS

| | | |
|---|---|---|
| CN | 1095421 | 11/1994 |
| CN | 1510155 | 7/2004 |
| CN | 1537175 | 10/2004 |
| JP | 11152520 | 6/1999 |
| JP | 2007146237 A * | 6/2007 |

* cited by examiner

*Primary Examiner* — Jessee Roe
*Assistant Examiner* — Jenny Wu
(74) *Attorney, Agent, or Firm* — Brooks Kushman P.C.

(57) ABSTRACT

The present disclosure discloses a heat treatment method for a bainitic turnout rail, which includes: naturally cooling the turnout rail at a temperature in an austenite region after being finishing rolled to 450-480° C. at a tread center of a rail head of the turnout rail; accelerated cooling the naturally cooled turnout rail to 230-270° C. at the tread center of the rail head, a cooling rate at the tread center and a non-working side of the rail head being 1.5-5.0° C./s, a cooling rate at the working side of the rail head increasing by 0.1-1.0° C./s based on 1.5-5.0° C./s; continuously accelerated cooling the working side, the tread center and the non-working side of the rail head at a cooling rate of 0.05-0.25° C./s to decrease a temperature of the tread center of the rail head to 265-270° C.; and finally, naturally cooling the turnout rail to an ambient temperature.

3 Claims, 1 Drawing Sheet

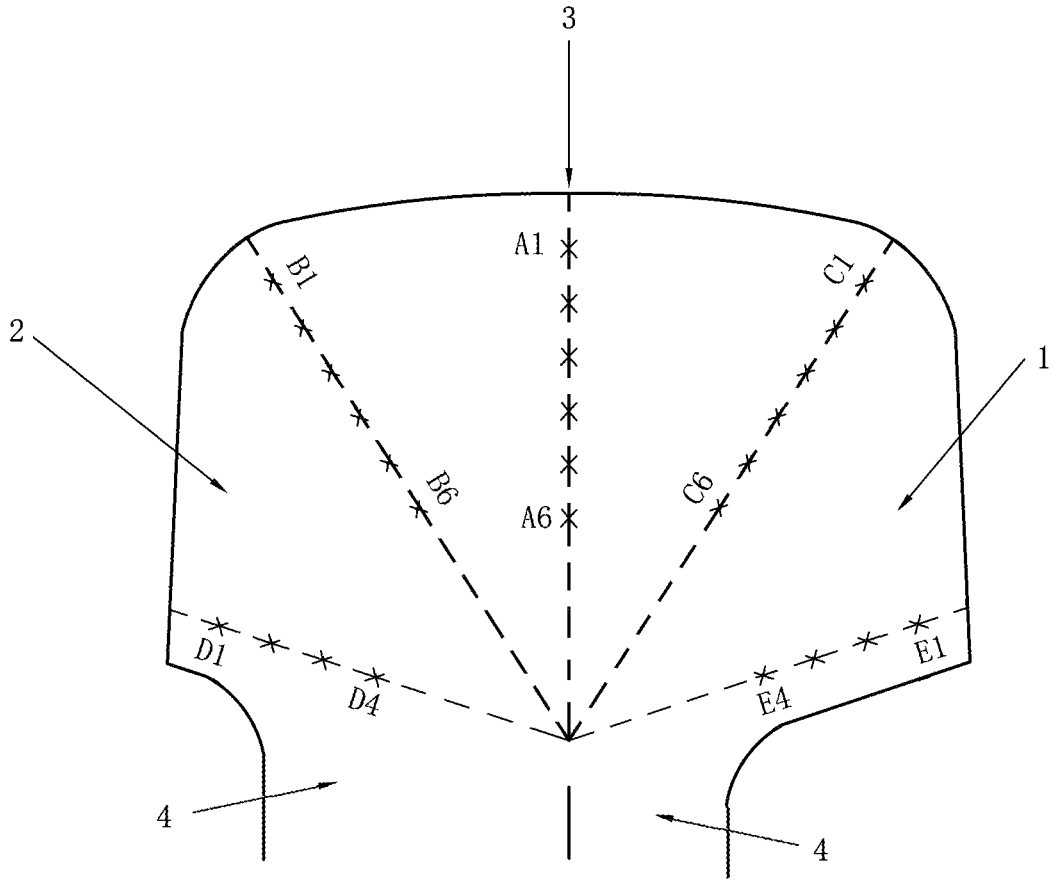
3
A1
B1
C1
2
1
B6
C6
A6
D1
E1
D4
E4
4
4

HEAT TREATMENT METHOD FOR BAINITIC TURNOUT RAIL

FIELD OF THE INVENTION

The present disclosure relates to a heat treatment method for a turnout rail, particularly, to a heat treatment method for a bainitic turnout rail.

DESCRIPTION OF RELATED ART

Railway turnout is a key connection part to guide a railway vehicle from one track to another track, of which the quality and property directly affect transportation efficiency and traffic safety of a railway. In addition to machining technology, the quality of turnout mainly depends on the quality of rail used to form the turnout. With the rapid development on heavy haul of railway in recent years, service conditions of the turnout rail are increasingly harsh, and lower parts of the turnouts need to be exchanged after a part of turnout rails are used for a couple of months or days only, thereby severely restricting development of the railway. Besides satisfying an index for higher hardness, more excellent strength and toughness match needs to be further obtained so as to improve properties of impact fatigue resistance and wear resistance of a turnout rail during research. The research shows that a turnout rail made of a bainitic material can satisfy the above requirements.

The current production of a turnout rail is implemented mainly by air cooling after rolling in cooperation with a subsequent tempering process. In addition, there is another method for obtaining a finer bainite microstructure by accelerated cooling after rolling.

In a patent application document with a publication No. CN1095421A, a method of manufacturing a bainite steel rail with high strength and good performance of anti-rolling-endurance-failure is disclosed, which comprises subjecting a head portion of a hot-rolled rail retaining or heated to a high temperature to accelerated cooling at a rate of 1 to 10° C./s, stopping accelerated cooling at a temperature of 500~300° C., followed by natural cooling or controlled cooling to an ambient temperature, so that a steel rail having a hardness of HV300~400 at an upper portion and a hardness of HV350 or more at an upper corner portion can be obtained.

Applying the above mentioned method to heat treatment of a turnout rail is problematic. In detail, since a general steel rail has a symmetrical cross-section, only property of the steel rail at its surface and as well as portions at a certain depth needs to be considered to satisfy use requirements during implementing accelerated cooling; however, as a raw material for manufacturing a turnout, a turnout steel rail can be used only by milling a rail head, the milled turnout rail needs to bear impact load caused by train wheels within a certain distance after a tip end of the rail head, and at this time, the part in contact with the wheels is located within a certain distance of a core of the rail head. As a result, the turnout rail not only requires a surface property of the rail head, but also emphasizes a key index of the core of the rail head. Meanwhile, a turnout rail has a non-symmetrical cross-section, a proportion of an area of a working side of the rail head is larger than that of an area of a non-working side thereof. If the same cooling process is adopted at both two sides, since the working side of the rail head has a high heat capacity and a slow cooling rate during accelerated cooling, an excellent property index cannot be obtained, and more importantly, one side with a relatively rapid cooling rate will be bent toward the other side with a relatively slow cooling rate during cooling, which is disadvantageous to overall length flatness of the turnout rail, namely, subsequent flattening process. Therefore, the prior methods cannot satisfy the production requirements of a turnout rail, there is a need for a heat treatment method for a bainitic turnout rail, which can satisfy property requirements of a surface layer and a core portion of the rail head, and can also solve disadvantageous influence on the overall length flatness caused by the non-symmetrical cross-section of the turnout rail.

SUMMARY OF THE INVENTION

The present disclosure is provided to overcome the above issues existing in the prior art, and the technical problem to be solved is to provide a heat treatment method which satisfies requirements for both a surface layer and a core portion of a rail head, and which can obtain a turnout rail with good overall length flatness. It needs to be noted that good overall length flatness indicates that the overall length direction of the turnout rail has a good flatness.

In order to realize the above purpose, the present disclosure provides a heat treatment method for a bainitic turnout rail, which includes steps of: a. naturally cooling a turnout rail at a temperature in an austenite region after finishing rolling to 450-480° C. at a tread center of a rail head of the turnout rail; b. accelerated cooling the naturally cooled turnout rail to 230-270° C. at the tread center of the rail head, wherein a cooling rate at the working side of the rail head is greater than a cooling rate at the tread center of the rail head and a non-working side of the rail head; c. continuously accelerated cooling the working side of the rail head, the tread center of the rail head and the non-working side of the rail head at a cooling rate of 0.05-0.25° C./s to decrease a temperature the tread center of the rail head to 265-270° C.; and d. finally, naturally cooling the turnout rail to an ambient temperature.

In step b, the cooling rate at the tread center of the rail head and the non-working side of the rail head of the turnout rail is 1.5-5.0° C./s, and the cooling rate of the working side of the rail head increases by 0.1-1.0° C./s based on 1.5-5.0° C./s.

According to the present disclosure, a cooling medium for the accelerated cooling is a mixed gas of water and air or a compressed air.

The indexes for tensile property, impact property at an ambient temperature and low temperature, and cross-section hardness of the rail head of the bainitic turnout rail obtained by the present disclosure are all effectively improved, especially in the hardness of the core of the bainitic turnout rail. Compared with the prior art, the advantageous effect of the present disclosure is to improve property of a core portion of the bainitic turnout rail, meanwhile, the turnout rail has a good overall length flatness.

DESCRIPTION OF FIGURES

FIG. 1 is a schematic view showing positions for measuring hardness of a cross-section of a rail head of a bainitic turnout rail.

DESCRIPTION OF REFERENCE NUMERALS

1: working side of a rail head; 2: non-working side of the rail head; 3: tread center of the rail head; and 4: rail web.

In the drawings, A1, B1, C1, D1 and E1 respectively represent five positions of a surface layer of the rail head, and A6, B6, C6, D4 and E4 respectively represent five positions of a core portion of the rail head.

DETAILED DESCRIPTION OF THE PREFERRED EMBODIMENTS

The present disclosure provides a heat treatment method for a bainitic turnout rail, which comprises naturally cooling a turnout rail standing upright on a bench or a roll table from a temperature in an austenite region after being finishing rolled to a temperature of 450-480° C. in a center of a tread of a rail head, and then accelerated cooling the naturally cooled turnout rail to a temperature of 230-270° C. in the center of the tread of the rail head using a mixed gas of water and air or a compressed air, wherein a cooling rate of cooling a working side of the rail head is greater than the cooling rate of cooling the center of the tread of the rail head and a non-working side of the rail head.

Here, the working side of the rail head indicates a portion where the turnout is rolled by wheels of a train and bears impact load while guiding running of the train after rail heads are milled and assembled to the turnout; the non-working side of the rail head indicates another side of the rail head not in contact with the wheels; and the tread of the rail head indicates a portion of a top surface of the rail head in contact with the wheels.

According to the present disclosure, the accelerated cooling begins when the center of the tread of the rail head is naturally cooled to a temperature of 450-480° C. If the temperature of the center of the tread of the rail head is higher than 480° C., a temperature of a surface layer of the rail head drops rapidly during the accelerated cooling, and there is a temperature difference between the surface layer of the rail head and a core portion of the rail head, that is, a temperature gradient occurs, causing the core portion of the rail head to have a higher temperature to transfer heat to the surface layer. Moreover, such a phenomenon lasts a certain period of time depending on the cooling rate, and as the accelerated cooling proceeds, the core portion of the rail head of the turnout rail is still at a high temperature at the beginning of phase transformation, so that a relatively coarse bainite microstructure is easily formed, thereby resulting in decreased mechanical property of the core portion of the rail head, which cannot sufficiently perform function of improving mechanical property by accelerated cooling. If the temperature of the center of the tread of the rail head is lower than 450° C., since it approaches the temperature of the phase transition point, the surface layer of the rail head is easy to form a martensite microstructure, which cannot transform during subsequent temperature rising process and finally remains at an ambient temperature, and existence of the martensite microstructure significantly increases the risk of brittle fracture of the turnout rail while coming under an impact load of wheels during the usage.

The ground for setting the first accelerated cooling temperature to be 230-270° C. for the temperature of the tread core of the rail head is: if the accelerated cooling temperature is lower than 230° C., the temperature of the rail head is excessively low, so that the amount of heat from the core portion of the rail head and a rail web is difficult to effectively supplement for the rail head so as to form a mass of martensite microstructures; and if the accelerated cooling temperature is higher than 270° C., the core portion of the rail head cannot perform phase transition under a higher degree of supercooling, so that an index of higher strength and hardness cannot be obtained, that is, the accelerated cooling cannot sufficiently serve to improve comprehensive mechanical property.

The cooling rate of the working side of the rail head of the turnout rail is set to be greater than the cooling rate of the center of the tread and the non-working side of the rail head. The ground for the above setting is: if cooling medium with the same cooling rate is applied to the center of the tread and both sides of the rail head, the cooling rate is relatively slow because of the working side of the rail head occupying a relatively large area and having a relatively high heat capacity, that is, the core portion has a strong capability of supplying heat, and the temperature at the working side of the rail head is increased apparently less than those at the tread center (i.e., the center of the tread) and the non-working side, which will cause the turnout rail to bend toward one side, that is, a phenomenon of side bending occurs. This phenomenon not only severely affects subsequent flattening process, but also results in abnormal situation such as fracture; meanwhile, residual stress of a center at a bottom of the turnout rail significantly increases, which cannot satisfy requirements. The above issue can be solved by appropriately increasing the cooling rate of the working side of the rail head during the accelerated cooling, and thus, the cooling rate of the working side of the rail head is higher than the cooling rate of the tread center and the non-working side of the rail head in the present disclosure.

The cooling rate of the tread center of the rail head and the non-working side of the rail head of the turnout rail is 1.5-5.0° C./s, the cooling rate of the working side of the rail head increases by 0.1-1.0° C./s on the basis of 1.5-5.0° C./s. The ground for limiting the cooling rate of the tread center and the non-working side of the rail head within a range of 1.5-5.0° C./s is: a martensite microstructure tends to be formed at the surface layer of the rail head due to being rapidly cooled when the cooling rate is higher than 5.0° C./s, and the martensite microstructure cannot transform during the temperature rises, which is disadvantageous to the safety of the turnout rail; and the temperature of the surface layer of the rail head significantly drops at the beginning of cooling if the cooling temperature is lower than 1.5° C./s, and then the temperature of the surface does not drop any more but rises conversely due to supplement of heat at the core portion of the rail head, which cannot accomplish the purpose of the accelerated cooling, accordingly, the cooling rate of the tread center and the non-working side of the rail head is limited within a range of 1.5-5.0° C./s. In addition, the amplitude of increasing the cooling rate of the working side of the rail head is 0.1-1.0° C./s, that is, the cooling rate of the working side of the rail head increases by 0.1-1.0° C./s on the basis of 1.5-5.0° C./s, and the specific increased value is determined within the above range depending on the characteristics of the type of steel to be processed and the applied basic cooling rate.

Subsequently, the working side of the rail head, the tread center of the rail head and the non-working side of the rail head are subject to continuously accelerated cooling at a cooling rate of 0.05-0.25° C./s, and the temperature of the tread center of the rail head is cooled to 265-270° C. again. During such a process, the rail web, the core portion of the rail head and the surface layer of the rail head constantly perform heat exchange so that the temperature of the rail head first rises and then drops, and when the temperature of the tread center of the rail head drops to 265-270° C. again, the accelerated cooling stops. The ground for stopping the accelerated cooling step at the temperature 265-270° C. is: the turnout rail has a relatively large cross-section, and the rail web is relatively thick, accordingly, the heat exchange capability is strong, most of bainite transformation has been accomplished at the rail head during the accelerated cooling, and the rest of bainite transformation gradually accomplishes during processes of slowly rising and dropping temperature. Thus, the phase transformation has been accomplished basically when the temperature of the tread core of the rail head drops to 265-270° C. again, and continuously applying the cooling medium has no obviously benefit to the properties of the turnout rail, conversely, is wasteful.

The ground for setting the cooling temperature of the second accelerated cooling to be 0.05-0.25° C./s is: when the cooling rate is lower than 0.05° C./s, the cooling cannot function well, and the temperature of the surface layer of the rail head significantly rises, which fails to achieve the purpose of the accelerated cooling; and when the cooling rate is higher than 0.25° C./s, the temperature of the surface of the rail head is difficult to slowly rise or even drops, which is not advantageous to the core portion of the rail head to form fine bainite microstructure. Accordingly, the cooling rate is set to be 0.05-0.25° C./s.

Finally, the turnout rail is naturally cooled to an ambient temperature.

According to an exemplary embodiment of the present disclosure, a cooling medium for the accelerated cooling is a mixture gas of water and air or a compressed air.

In an exemplary embodiment of the present disclosure, under a process condition which comprises smelting in converter, refining in an LF furnace, RH vacuum processing, and continuous casting, a billet having a certain size is generated, and then is transferred to a heating furnace to be heated. The heating is generally performed at 1200-1300° C. for 3-6 h. Next, the billet is rolled to be a turnout rail with a desired cross-section by using a pass rolling method or a universal rolling method, and the turnout rail after being rolled has a temperature of 850-1000° C. at a surface layer thereof.

In an exemplary embodiment of the present disclosure, the natural cooling is performed by making the turnout rail upright on a roll table or a bench to be naturally cooled in air.

Furthermore, in conjunction with a rail head of a turnout rail as illustrated in FIG. 1, a heat treatment method for a turnout rail according to the present disclosure can also be implemented as follows.

In particular, the turnout rail is naturally cooled from a temperature at an austenite region after being finishing rolled to a temperature of 450-480° C. at a tread center of a rail head of the turnout rail.

Thereafter, a mixed gas of water and air or a compressed air is respectively applied to a working side 1, a non-working side 2 and a tread center 3 of the rail head, so that the cooling rate of the non-working side 2 and the tread center 3 of the rail head is 1.5-5.0° C./s, and on this basis, the cooling rate of the working side 1 of the rail head increases by 0.1-1.0° C./s. The tread center 3 of the rail head is accelerated cooled to a temperature of 230-270° C.

Subsequently, the working side 1, the non-working side 2 and the tread center 3 of the rail head are continuously accelerated cooled at a cooling rate of 0.05-0.25° C./s, to cool the tread center 3 of the rail head to a temperature of 265-270° C. again.

Finally, the turnout rail is naturally cooled to an ambient temperature.

The heat treatment method for a bainitic turnout rail of the present disclosure is further explained in conjunction with exemplary examples and comparative examples.

EXEMPLARY EXAMPLES 1-8

By using the heat treatment method according to the present disclosure, billets having components shown in Table 1 were rolled to be AT60 turnout rails, and the turnout rails in a phase region of austenite were then heat treated according to 8 groups of parameters listed in Table 2. Next, a hardness test was performed on a cross-section of a rail head of each of the turnout rails every other 5 mm along a dotted line as illustrated in FIG. 1 according to a method of measuring a hardness of a cross-section of a rail head in the prior art, and in the present disclosure, measurement results of 10 points including points A1, B1, C1, D1, E1, A6, B6, C6, D4 and E4 in FIG. 1 were only selected to be analyzed, wherein a distance from respective points A1, B1, C1, D1 and E1 to a surface of the rail head was 5 mm, a distance from respective points A6, B6 and C6 to the surface of the rail head was 30 mm, a distance from respective points D4 and E4 to the surface of the rail head was 20 mm. Meanwhile, tensile and impact properties were tested on a working side of the rail head of each of the turnout rails.

Table 1 illustrates chemical components of the billets in Exemplary Examples 1-8, Table 2 illustrates process control parameters in Exemplary Examples 1-8 (including a starting temperature of the accelerated cooling, an accelerated cooling rate at a working side of a rail head, an accelerated cooling rate at a tread center and a non-working side of the rail head, a difference between the cooling rates of the working side and the non-working side of the rail head, a temperature at the tread center of the rail head after a first accelerated cooling, a second accelerated cooling rate, and a finish temperature of the tread center of the rail head), and Tables 4 and 5 partly list measurement results of mechanical properties in Exemplary Examples 1-8 (including tensile property, impact property, and hardness/HRC of a cross-section of a rail head).

COMPARATIVE EXAMPLES 1-8

By using a method disclosed in a Chinese patent with a publication No. CN1095421A, billets having components shown in Table 1 were rolled to be AT60 turnout rails, and the turnout rails having residual heat were then heat treated according to 8 groups of parameters listed in Table 3. Next, a hardness test was performed on a cross-section of a rail head of each of the turnout rails every other 5 mm along a dotted line as illustrated in FIG. 1 according to the method of measuring a hardness of a cross-section of a rail head in the prior art, and in the present disclosure, measurement results of 10 points including points A1, B1, C1, D1, E1, A6, B6, C6, D4 and E4 in FIG. 1 were only selected to be analyzed, wherein a distance from respective points A1, B1, C1, D1 and E1 to a surface of a rail head was 5 mm, a distance from respective points A6, B6 and C6 to the surface of the rail head was 30 mm, and a distance from respective points D4 and E4 to the surface of the rail head was 20 mm. Meanwhile, tensile property and impact property were tested on a working side of the rail head each of the turnout rails. Tables 4 and 5 partly list measurement results of mechanical properties in Comparative Examples 1-8 (including tensile property, impact property, and hardness/HRC of a cross-section of the rail head).

TABLE 1

Chemical components of the turnout rails in Exemplary Examples 1-8 and Comparative Examples 1-8

| Nos. of Exemplary/ Comparative Examples | Chemical component/% | | | | | | |
|---|---|---|---|---|---|---|---|
| | C | Si | Mn | P | S | Cr | Mo |
| 1 | 0.23 | 1.25 | 1.95 | 0.012 | 0.003 | 0.42 | 0.35 |
| 2 | 0.30 | 0.85 | 2.25 | 0.011 | 0.006 | 0.30 | 0.30 |
| 3 | 0.26 | 1.33 | 1.87 | 0.015 | 0.009 | 0.65 | 0.28 |
| 4 | 0.20 | 1.65 | 2.18 | 0.011 | 0.005 | 0.55 | 0.41 |
| 5 | 0.22 | 1.52 | 2.30 | 0.013 | 0.009 | 0.49 | 0.32 |
| 6 | 0.28 | 1.35 | 1.55 | 0.016 | 0.010 | 0.32 | 0.41 |
| 7 | 0.35 | 1.55 | 1.65 | 0.011 | 0.016 | 0.15 | 0.36 |
| 8 | 0.22 | 1.30 | 1.99 | 0.012 | 0.009 | 0.25 | 0.40 |

TABLE 2

Process control parameters in Exemplary Examples 1-8

| Items | Nos. | Staring temperature of accelerated cooling, ° C. | Accelerated cooling rate at working side of rail head, ° C./s | Accelerated cooling rate at tread center and non-working side of rail head, ° C./s | Difference between cooling rate at working side and non-working side of rail head, ° C./s | Temperature at tread center of rail head after firstly accelerated cooling, ° C. | Second accelerated cooling rate, ° C./s | Finish temperature of tread center of rail head, ° C. |
|---|---|---|---|---|---|---|---|---|
| Exemplary Examples. | 1 | 472 | 3.6 | 3.2 | 0.4 | 262 | 0.18 | 268 |
| | 2 | 466 | 3.0 | 2.0 | 1.0 | 258 | 0.10 | 269 |
| | 3 | 479 | 4.0 | 3.8 | 0.2 | 238 | 0.15 | 265 |
| | 4 | 462 | 2.7 | 2.6 | 0.1 | 269 | 0.25 | 268 |
| | 5 | 451 | 2.1 | 1.5 | 0.6 | 253 | 0.10 | 270 |
| | 6 | 475 | 4.3 | 4.1 | 0.2 | 268 | 0.16 | 268 |
| | 7 | 478 | 5.7 | 5.0 | 0.7 | 231 | 0.05 | 266 |
| | 8 | 475 | 2.3 | 1.8 | 0.5 | 266 | 0.22 | 268 |

TABLE 3

Process control parameters in Comparative Examples 1-8

| Items | Nos. | Staring temperature of accelerated cooling, ° C. | Accelerated cooling rate at tread center and both sides of turnout rail, ° C./s | Finish temperature of accelerated cooling, ° C. | Highest temperature risen again at tread center after stop accelerated cooling, ° C. |
|---|---|---|---|---|---|
| Comparative Examples | 1 | 850 | 3.2 | 385 | 452 |
| | 2 | 822 | 2.0 | 412 | 488 |
| | 3 | 780 | 3.8 | 395 | 440 |
| | 4 | 885 | 2.6 | 377 | 425 |
| | 5 | 835 | 1.5 | 488 | 562 |
| | 6 | 811 | 4.1 | 425 | 491 |
| | 7 | 767 | 5.0 | 325 | 386 |
| | 8 | 812 | 1.8 | 363 | 445 |

TABLE 4

Measurement results of tensile and impact properties in Exemplary Examples 1-8 and Comparative Examples 1-8

| | | Tensile property | | | | Impact property, Aku/J | |
|---|---|---|---|---|---|---|---|
| | | | | | | Ambient | |
| Items | Nos. | Rp0.2, MPa | Rm, MPa | A, % | Z, % | Temperature | −40° C. |
| Exemplary Examples | 1# | 1080 | 1340 | 17.0 | 58 | 86 | 55 |
| | 2# | 1100 | 1390 | 16.5 | 60 | 68 | 50 |
| | 3# | 1065 | 1290 | 18.0 | 64 | 78 | 52 |
| | 4# | 1055 | 1280 | 17.5 | 54 | 82 | 66 |
| | 5# | 1040 | 1270 | 19.5 | 66 | 99 | 76 |
| | 6# | 1085 | 1350 | 18.5 | 62 | 75 | 50 |
| | 7# | 1130 | 1410 | 15.0 | 44 | 50 | 38 |
| | 8# | 1035 | 1300 | 17.0 | 48 | 58 | 45 |
| Comparative Examples | 1# | 1050 | 1310 | 16.5 | 54 | 90 | 58 |
| | 2# | 1080 | 1380 | 16.0 | 58 | 70 | 48 |
| | 3# | 1055 | 1290 | 17.5 | 68 | 70 | 52 |
| | 4# | 1040 | 1270 | 17.0 | 50 | 78 | 62 |
| | 5# | 1020 | 1270 | 20.0 | 70 | 90 | 78 |
| | 6# | 1060 | 1320 | 19.0 | 64 | 78 | 56 |
| | 7# | 1140 | 1420 | 15.5 | 42 | 54 | 40 |
| | 8# | 1025 | 1310 | 17.5 | 52 | 55 | 46 |

TABLE 5

Measurement results of hardness of cross-sections of rail heads in Exemplary Examples 1-8 and Comparative Examples 1-8

| | | Hardness of cross-section of rail head, HRC | | | | | | | | | |
|---|---|---|---|---|---|---|---|---|---|---|---|
| | | Working side | | | | Tread | | Non-working side | | | |
| Items | Nos. | C1 | C6 | E1 | E4 | A1 | A6 | B1 | B6 | D1 | D4 |
| Exemplary Examples | 1# | 43.5 | 44.0 | 43.0 | 42.5 | 43.0 | 42.5 | 43.0 | 43.0 | 42.5 | 42.0 |
| | 2# | 44.0 | 43.5 | 43.5 | 43.0 | 43.5 | 43.5 | 43.5 | 44.0 | 43.0 | 43.0 |
| | 3# | 44.0 | 44.0 | 44.0 | 43.5 | 43.0 | 43.0 | 43.5 | 43.0 | 43.5 | 43.0 |
| | 4# | 43.5 | 43.5 | 43.5 | 44.0 | 42.5 | 42.0 | 43.0 | 43.0 | 43.0 | 42.5 |
| | 5# | 44.0 | 44.0 | 44.0 | 44.0 | 42.0 | 42.0 | 43.5 | 43.0 | 43.0 | 43.5 |
| | 6# | 43.5 | 44.0 | 43.5 | 44.0 | 43.5 | 43.0 | 43.5 | 43.0 | 43.5 | 44.0 |
| | 7# | 45.5 | 45.0 | 45.0 | 44.5 | 45.0 | 44.0 | 45.0 | 44.0 | 45.0 | 45.0 |
| | 8# | 43.5 | 44.0 | 43.5 | 44.0 | 42.5 | 42.0 | 43.0 | 43.5 | 43.5 | 43.5 |
| Comparative Examples | 1# | 43.5 | 41.0 | 43.0 | 39.5 | 42.5 | 40.0 | 43.5 | 40.5 | 43.0 | 39.5 |
| | 2# | 44.0 | 40.5 | 43.0 | 39.0 | 43.5 | 40.5 | 44.0 | 41.0 | 43.5 | 39.5 |
| | 3# | 43.5 | 40.5 | 43.0 | 39.5 | 42.5 | 39.5 | 43.5 | 40.5 | 43.0 | 39.5 |
| | 4# | 43.5 | 40.5 | 43.5 | 39.0 | 43.0 | 40.0 | 43.5 | 40.0 | 44.0 | 40.0 |

TABLE 5-continued

| Measurement results of hardness of cross-sections of rail heads in Exemplary Examples 1-8 and Comparative Examples 1-8 | | | | | | | | | | | |
|---|---|---|---|---|---|---|---|---|---|---|---|
| | | Hardness of cross-section of rail head, HRC | | | | | | | | | |
| | | Working side | | | | Tread | | Non-working side | | | |
| Items | Nos. | C1 | C6 | E1 | E4 | A1 | A6 | B1 | B6 | D1 | D4 |
| | 5# | 43.0 | 40.0 | 43.0 | 39.5 | 42.0 | 39.0 | 42.5 | 39.5 | 43.5 | 40.0 |
| | 6# | 44.0 | 41.0 | 43.0 | 40.5 | 43.5 | 40.5 | 44.0 | 40.5 | 43.5 | 40.0 |
| | 7# | 44.5 | 41.0 | 43.5 | 40.5 | 44.5 | 41.5 | 45.0 | 41.5 | 44.0 | 40.5 |
| | 8# | 43.5 | 40.0 | 43.0 | 40.0 | 43.0 | 40.5 | 43.5 | 40.0 | 43.0 | 39.5 |

It can be seen from Tables 1-5 that, for the turnout rails with the same chemical components (Table 1) and subjecting to the same smelting and rolling processes, different methods of heat treatments (Tables 2 and 3) for turnout rails after being rolled will have significant effects on the final properties (Tables 4 and 5) of the turnout rails. More particularly, by using the method according to the present disclosure, i.e., for Exemplary Examples 1-8, indexes of the bainitic turnout rail, such as tensile property, impact properties at an ambient temperature and low temperature, and cross-section hardness of the rail head, are all effectively improved, especially, the hardness of the part below the rail head at 30 mm (the core portion of the rail head) is not significantly lowered, which is advantageous to the property of the turnout after milling process. By contrast, the hardness of the part below the surface of the rail head at 30 mm (the core of the rail head) is apparently lowered by 3HRC, while obtaining an ideal hardness of the surface of the rail head in Comparative Examples 1-8 by using the method disclosed in the prior relevant patent, the life of the turnout is seriously reduced under the impact load of the wheels, which cannot effectively heat treat the turnout rail to its advantage.

In conclusion, the indexes for tensile property, impact property at an ambient temperature and low temperature resistance and cross-section hardness of the rail head of the bainitic turnout rail obtained by the present disclosure are all effectively improved, especially in the hardness of the core portion of the bainitic turnout rail. The method of the present disclosure can obtain a bainitic turnout rail with a part below a surface of a rail head thereof at 30 mm (the core portion of the rail head) with the same hardness as that of a surface layer of the rail head while obtaining a more excellent strength-toughness index, and thus can effectively improve the hardness of the core portion of the turnout rail head. The product obtained by the method is suitable for ordinary railways with passengers and freight traffic and heavy-loaded railways which require high properties of contact fatigue damage resistance and abrasion resistance. In addition, the present disclosure can obtain a turnout rail with good flatness by using a non-symmetrical cooling method, which helps to improve ride performance of railway lines.

What is claimed is:

1. A heat treatment method for a bainitic turnout rail, comprising steps of:

a. naturally cooling the turnout rail at a temperature in an austenite region after being finishing rolled to 450-480° C. at a tread center of a rail head of the turnout rail;

b. accelerated cooling the naturally cooled turnout rail to 230-270° C. at the tread center of the rail head, wherein a cooling rate at a working side of the rail head is greater than a cooling rate at the tread center of the rail head and a non-working side of the rail head;

c. continuously accelerated cooling the working side, the tread center and the non-working side of the rail head at a cooling rate of 0.05-0.25° C./s to decrease a temperature of the tread center of the rail head to 265-270° C.; and d. finally, naturally cooling the turnout rail to an ambient temperature.

2. The heat treatment method of claim 1, wherein in step b, the cooling rate at the tread center of the rail head and the non-working side of the rail head of the turnout rail is 1.5-5.0° C./s, and the cooling rate of the working side of the rail head increases by 0.1-1.0° C./s based on 1.5-5.0° C./s.

3. The heat treatment method of claim 1, wherein a cooling medium for the accelerated cooling is a compressed air or a mixed gas of water and air.

* * * * *